US006151479A

United States Patent [19]

Kummer

[11] Patent Number: 6,151,479

[45] Date of Patent: Nov. 21, 2000

[54] SINGLE CLOCK 27 MHZ OSCILLATOR IN MPEG-2 SYSTEM

[75] Inventor: David A. Kummer, Highlands Ranch, Colo.

[73] Assignee: EchoStar Engineering Corp., Littleton, Colo.

[21] Appl. No.: 08/868,167

[22] Filed: Jun. 3, 1997

Related U.S. Application Data

[60] Provisional application No. 06/019,080, Jun. 3, 1996.

[51] Int. Cl.[7] ..... H04H 1/00

[52] U.S. Cl. ..... 455/3.2; 455/71; 455/258; 455/259; 348/6; 348/7; 348/423; 348/521; 331/25; 327/115; 327/117

[58] Field of Search ..... 455/3.2, 258, 259, 455/265, 70, 71; 348/6, 7, 12, 13, 423, 516, 521, 723, 845.2, 424, 425, 462, 464, 845.1, 845.3; 331/25; 327/113, 115, 116, 117

[56] References Cited

U.S. PATENT DOCUMENTS

| | | | |
|---|---|---|---|
| 4,163,946 | 8/1979 | Alberts | 328/63 |
| 4,540,945 | 9/1985 | Kuroki | 328/134 |
| 4,698,678 | 10/1987 | Collins | 348/518 |
| 5,493,710 | 2/1996 | Takahara et al. | 455/192.2 |
| 5,703,537 | 12/1997 | Bland et al. | 331/1 |
| 5,825,254 | 10/1998 | Lee | 331/25 |

OTHER PUBLICATIONS van der Waal et al., Current and future standardization of high–quality digital audio coding in MPEG, Application of Signal Processing to Audio and Acoustics, IEEE 1993. Whole document, 1993.

*Primary Examiner*—Andrew I. Faile
*Assistant Examiner*—Habte Bahgi
*Attorney, Agent, or Firm*—Kerry Miller

[57] ABSTRACT

This invention provides a method of generating multiple frequencies for use in a digital data transmission system including a remote transmitter and receiver. The reference frequency used in the transmitter is replicated in a remote receiver. A single crystal oscillator is used to generate a reference frequency similar to that used in the transmitter. The receiver reference frequency is manipulated by dividing the frequency into required multiple frequencies for use within the receiver. A constant comparison is made between the clock signal received in the transmitted data stream with the receiver reference frequency and the divisors are adjusted accordingly to maintain the clock frequency in the receiver within a predetermined tolerance range. This allows the output signal for display from the receiver to match the quality of the input display provided to the transmitter.

4 Claims, 3 Drawing Sheets

SINGLE CLOCK 27 MHZ OSCILLATOR IN MPEG-2 SYSTEM

This application claims the benefit of U.S. Provisional patent application No. 60/019,080, filed Jun. 3, 1996, which is now abandoned.

FIELD OF THE INVENTION

The present invention addresses the need to provide multiple frequencies to decode and display digital transmissions which utilize the MPEG-2 standard. Additionally, the invention herein disclosed could be utilized in any apparatus which requires inexpensive multiple frequency sources which can be adjusted so as to compensate for the drift in an independently generated frequency such as one coming from a ground station satellite transmitter.

BACKGROUND OF THE INVENTION

With the advent of digital television signals, either directly from satellites or soon from fixed towers, a need has arisen for many reliable, adjustable clock sources. In the past, system designers have utilized up to six crystal oscillators, each oscillating at a different frequency. These oscillators provide the timing necessary for the multitude of integrated circuits utilized to synchronize, descramble, demultiplex, and decode the MPEG-2 digital signals. Providing six or more oscillators drastically increases the cost of a Direct Broadcast Satellite (DBS) receiver. Instead of using multiple oscillators, the present invention provides the six MPEG-2 audio sampling frequencies plus the video frequencies and other frequencies utilized by DBS receiver systems by using one oscillator.

SUMMARY OF THE INVENTION

It is the object of the present invention to provide the six sampling frequencies (32 Khz, 44.1 Khz, 48 Khz, 16 Khz, 22.05 Khz, and 24 Khz) required by the MPEG-2 audio standard by using a 256 times over sampling Digital to Analog Converter (DAC) which requires a 32 Khz times 256 and etc. clock input. This is accomplished with only one crystal instead of six crystals thereby drastically reducing the cost of the overall satellite receiver.

Uplink transmissions include 27 MHZ clock timing, and other frequencies used in the encoding of video and audio signals. Downlink data includes a 27 MHZ clock pulse for synchronization. Receiver operates separate and independent but must be synchronized with the incoming video and audio frames for timing purposes during decoding of the digital information.

It is a further object of this invention to provide a Central Processing Unit (CPU) and modem clock using the same technique.

Additionally it is an object of this invention to provide adjustable frequencies for a multitude of uses based upon one crystal and the techniques herein disclosed.

BRIEF DESCRIPTION OF THE DRAWINGS

The present invention will be better understood by reference to the following detailed description of the preferred embodiment of the invention when taken in conjunction with the drawings herein.

DETAILED DESCRIPTION OF THE INVENTION

Figure 1:
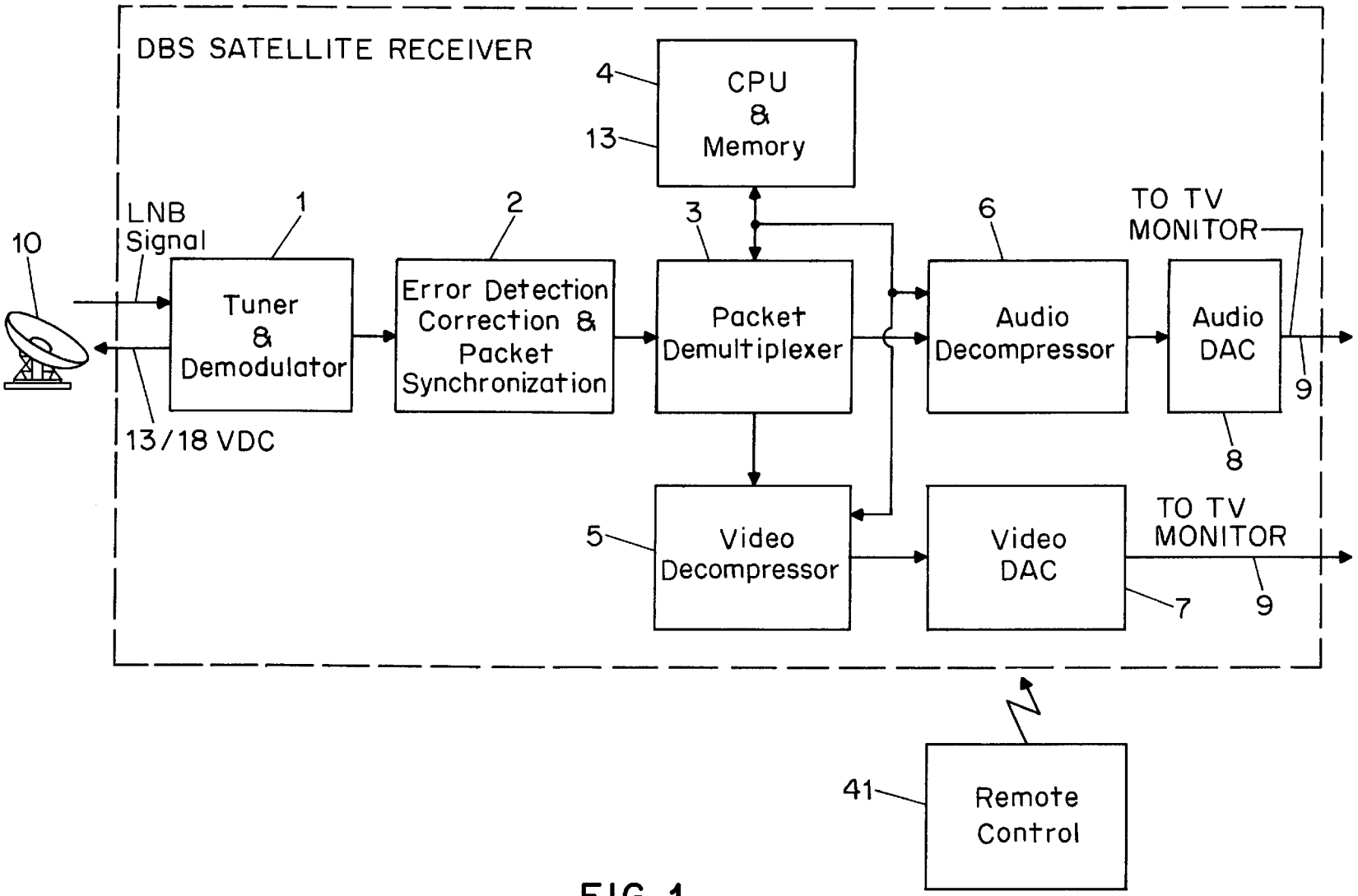
FIG. 1 is a block diagram of a digital satellite receiver, for which components the invention disclosed herein will provide reliable and accurate timing.

FIG. 1 shows the typical components used in a satellite receiver system. The satellite dish 10 receives the signal transmitted from the geosynchronous communications satellite. The signal is then sent through a Low Noise Down Block converter (LNB) located at the satellite dish 10. Next the signal is sent to the tuner and demodulator 1, where a particular channel out of a possible 10 per frequency is obtained by the tuner from the broadband satellite transmission and then separated from the carrier signal by demodulation techniques. Having been stripped from the main carrier the signal is now in the MPEG-2 digital format. It is next sent to the error detection correction and packet synchronization module 2. Within this module the digital data stream is synchronized. Synchronization is analogous to page and topic headings in an encyclopedia. Without such information a reader would not know what they were reading. The same applies to streams of digital data, the processors must know on which page, chapter, verse the data they are receiving is contained in order to process the data further. After the receiver has determined where it is in the data stream, the signal is sent to the packet demultiplexer 3.

The satellite television signal is primarily comprised of MPEG-2 transport streams. Basically a transport stream is a combination of digitally encoded video and audio data from one or many different programs which have been sliced into digital packets of information. This is analogous to a novel being sent one page at a time instead of all pages at once. Each packet relates to a specific program. The packet demultiplexer determines which program each packet belongs to and routes the data appropriately. Additionally, video and audio data are separated. The separate video and audio data streams are then decompressed according to the MPEG-2 standards in the Audio decompressor 6 and the Video decompressor 5. Digital data before it is transmitted is compressed. Compression can be accomplished by many methods, but it basically entails sending only those bits of data which have changed from the previous scanning of the picture. Thus, if a baseball game was being televised and the camera's position and field of view never changed, data on the view of the field itself (which really never changes) would not have to be continuously transmitted. Instead the digital television signal would transmit the change in the player's position, etc. After decompression the digital signals are converted to analog baseband signals in the audio DAC (digital Analog Converter) 8 and the video DAC 9. The audio signals are then processed on the television monitor and are heard through the appropriate speakers. A CPU 4 controls the operation of all these components.

Each of these components utilizes multiple clocking sources. The data transmitted by the uplinking satellite television system provider is synchronized by a reference 27+/−5 ppm MHz clock at the uplink site. Since the reference source may very by 5 ppm, the uplinked frequency and the frequency received by the satellite dish at the receiver site may vary. In order to ensure synchronization of the data a Coded Time Stamp (CTS) is included in the uplinked data signal. The CTS allows synchronization of the video and audio packets thereby ensuring an accurate lipsinc in the resulting display. Since the uplinked frequency may very over time, the relative spacing of the packets of data will vary. Thus, at any particular time data may be arriving sooner or later (i.e. the clock drifts by 5 ppm) than the previous data arrived. Since the receiver's system clock is not locked into the frequency of the data stream received from the uplink center, this variation in data flow results in either too much data or not enough being processed at the receiver.

Figure 2:
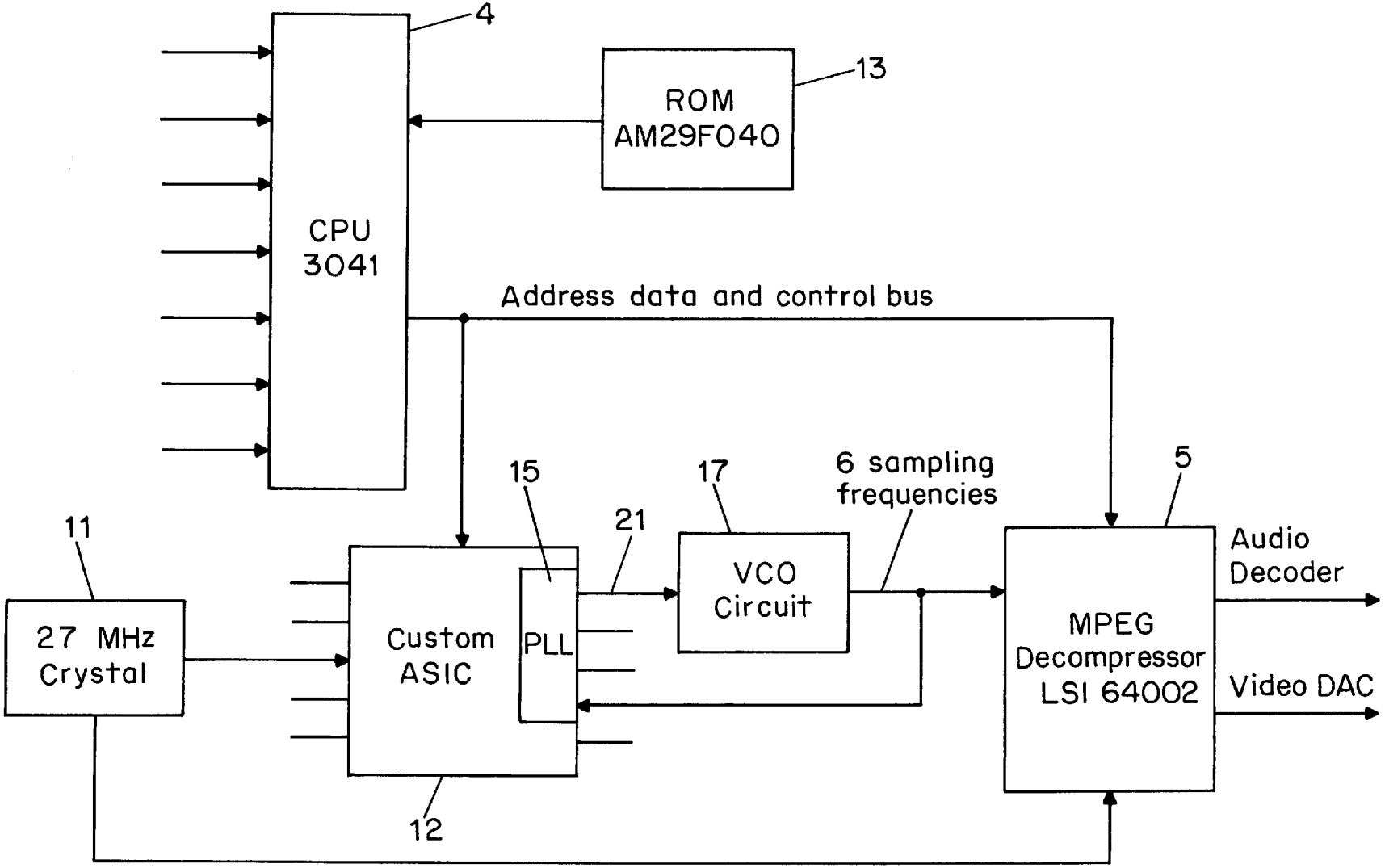
FIG. 2 is a block diagram of the video reconstruction circuit.

For video data the 5 ppm drift is not significant. Because of the timing factor, when too much data is processed a frame is merely dropped or slipped (called "frame slipping"). When too little data is processed a frame is repeated. Since frames are either slipped or repeated so infrequently, the slipped/repeated frames are not noticeable to the viewer. FIG. 2 shows the components used to perform "frame slipping" with a set 27 MHZ frequency crystal 11. Within the Application Specific Integrated Circuit (ASIC) 12 the digital data stream is synchronized, depacketized, and the video signal created. The video signal is then sent to the video decompressor 5 where the data is decompressed, decoded, and sent to the memory 13. The CPU 4 takes the data stored in the memory 13 and creates the video at 30 frames per second which is sent to the Video DAC 7. While the video is created the receiver is constantly comparing the time stamp received from the uplink center with the time stamp of the video created. If the receiver is processing the data slower than it is being received (i.e. the receivers 27 MHZ clock is slower than the clock at the uplink site) the CPU 4 will decide too much data is waiting to be processed and will drop or slip a frame. The frame is dropped in 1/30th of a second and is imperceptible to the human eye. A similar occurrence happens when the receiver is running faster than the uplink site. Not enough data is being received so the processor repeats a previously displayed frame. The frame is repeated at a rate imperceptible to the human eye. Frame slipping is an easy, imperceptible way of synchronizing the different video data rates.

Figure 3:
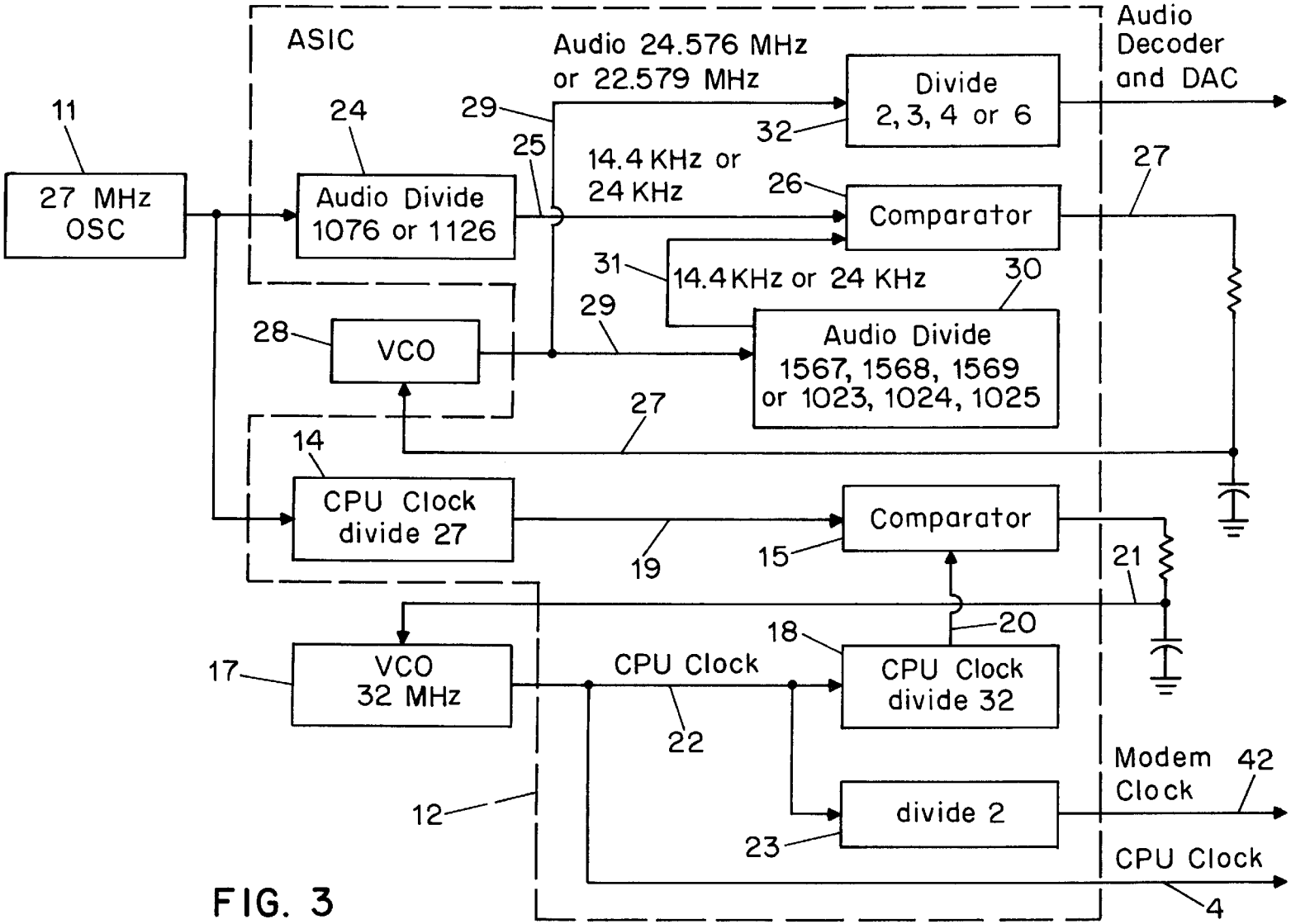
FIG. 3 is a block diagram of the CPU and modem clock generation circuit, and of the audio reference timing signal generation.

FIG. 3 shows the CPU 4 and Modem 42 clock generation circuitry. The modem 42 allows for the receiver to be programmed to receive pay per view programs by obtaining access codes via modem from the DBS system operator. This invention allows for the speeding up or slowing down of the CPU and modem clocks generated by the 27 MHZ crystal 11 such that a stable 32 MHZ and 16 MHZ clock is available for the CPU and modem respectively. The 27 MHZ frequency signal is sent to the ASIC 12. Within the ASIC 12 the signal is sent through a divide by 27 circuit 14 which outputs a 1 MHZ reference frequency 19. The 1 MHZ reference frequency 19 is then sent through a Phase detector or Phase Lock Loop (PLL) 15. Next, the clock signal is fed via lead 21 to a Voltage Controlled Oscillator (VCO) 17. The VCO 17 outputs a 32 MHZ clock signal. This signal is fed back through a divide by 32 18 circuit which outputs a second 1 Mhz reference frequency 20. The second 1 MHZ reference frequency 20 is then fed back into the PLL 15. If the PLL 15 determines the first 1 MHZ frequency 19 is slower than the second 1 MHZ frequency 20 a higher error voltage 21 is sent to the VCO 17 which causes the VCO 17 to increase the frequency of oscillation. Similarly, if the second 1 Mhz frequency 20 is slower than the first MHz frequency 19 the error voltage 21 decreases which causes the VCO 17 to decrease the frequency of oscillation. In this manner, the deviations from 27 Mhz by the crystal 11 are compensated and a steady clock source is generated. Thus, the VCO outputs a steady 32 Mhz frequency 22 which is used by the CPU 4. This 32 MHZ frequency 22 is also sent through a divide by 2 circuit 23, which outputs a steady 16 Mhz frequency 24 for the modem 14.

As shown in FIG. 1, the DBS receiver processes audio as well as video data. Once again the DBS signal is received by the satellite dish 10. The desired channel is stripped from the main carrier by the tuner and demodulator 1 and sent to the ASIC 12 where the audio packets are separated from the main data stream, synchronized and demultiplexed. Next, like the video data, the audio data is uncompressed in the audio decompressor 6, converted to analog in the audio DAC 8 and sent to the TV monitor 9 for broadcast over a speaker.

In order to separate the audio data from the remainder of the received data stream and broadcast the audio data over a speaker, the MPEG-2 audio standard requires six sampling frequencies: 16 KHz, 22.05 Khz, 24 KHz, 32 KHz, 44.1 KHz, and 48 Khz. Since the audio DAC 8 uses 256 times oversampling, clock frequencies of 4.1 MHZ, 5.65 MHZ, 6.14 MHZ, 8.19 MHZ, 11.28 MHZ, and 12.28 MHZ must be generated. The audio clock frequency needed at any time is determined by software loaded into the CPU 4. The CPU 4 will configure the divider circuits located within the ASIC 12 such that the desired audio clock frequency is generated. The desired audio clock frequency is generated from the same fixed 27 MHZ clock used to generate the video, CPU, and modem clocks.

As shown in FIG. 3, the 27 MHZ crystal 11 provides a 27 MHZ +/−25 ppm frequency to Divider A 24, which divides the 27 MHZ signal by either 1125 or 1875 thereby creating either a 24 KHz or a 14.4 KHz first reference frequency on lead 25. This first reference frequency is then provided as one of two inputs to the Audio Phase Detect 26 circuit. Connected to the audio phase detect 26 is a VCO 28 which creates frequencies of either 22.579 MHZ or 24.576 MHZ.

The output of the VCO 28 is sent on lead 29 to Divider B 30. The value of divider B 30 is nominally 1568 when the VCO 28 output is 22.579 MHZ thereby creating a reference frequency of 14.4 KHz on lead 31, or nominally 1024 when the VCO 28 output is 24.576 MHZ creating a 24 KHz reference frequency on lead 31. The reference frequency on lead 31 is compared in the audio phase detect 26 with the reference frequency on lead 25. The output of the audio phase detect 26 is the error voltage on lead 27 which is sent to the VCO 28 where the desired frequency of either 22.579 MHZ or 24.576 MHZ is created. At the audio phase detect 26 the reference frequencies are compared. If the first reference frequency on lead 25 is higher than the second reference frequency on lead 31, a slightly higher error voltage is sent on lead 27 to the VCO 28 causing an increase in frequency to be generated. Similarly, if the first reference frequency is lower than the second reference frequency the error voltage on lead 27 is reduced, thereby causing the VCO 28 to reduce the frequency it generates. This process continues in order to keep both reference frequencies the same. In order to make the average frequency exactly match the 27 MHz frequency from the uplink, the value of Divider B 30 can be change to +/−1 from the nominal values of 1024 or 1568. The output frequency of the VCO 28 is determined by dividing 27 MHZ +/−25 ppm crystal frequency by the value in Divider A 24, then multiplying the result by the value in Divider B 30. The VCO 28 output is then used to generate the six MPEG-2 audio frequencies.

The VCO 28 output on lead 29 is sent to Divider C 32. Divider C can divide the signal upon lead 29 by 2, 3, 4, or 6. The factor used is determined by the CPU 4 based upon the frequency needed at 256 times oversample. FIG. 3 shows the dividers needed in the three dividers to generate the desired output frequencies.

The synchronization of the DBS receiver with the uplinked 27 MHZ frequency clock for audio signals, unlike video signals, can not be accomplished by simply repeating or slipping frames. Video frame repeating/slipping at 30 frames per second is imperceptible to the human eye. Audio frame repeating/slipping is not. Thus, to receive acceptable digital audio, the frequency of the clocks at the receiving site must be slightly adjusted up or down such that the average frequency is the same as the 27 MHZ +/−25 ppm frequency tolerance generated at the uplink site. For example, a 48 KHz (or 12.28 MHZ, at 256 times oversampling) audio clock is desired. If the 27 MHZ crystals at both the uplink and receive sites were at their center frequency, no frequency corrections at the receiving site would be needed and the dividers could be set as follows: Divider A 24 at 1125, Divider B 30 at 1024, and Divider C 32 at 2. Such conditions, however, are the exception. Either the 27 MHZ frequency oscillator at the uplink site or the 27 MHZ frequency oscillator 11 at the receive site will be slightly off the center frequency but within the acceptable +/−25 ppm.

If the 27 MHZ crystal at the uplink center is generating a signal on the higher (+25 ppm) side of the tolerance, and the receiver clock was exactly at 27 MHZ, the audio clock frequency at the receiver would have to be increased in order to maintain synchronization. Otherwise, the DBS|receiver would receive audio data faster than it could process the data, the memory would become full, and data would have to be dropped, thereby degrading the audio quality below acceptable levels. To obtain synchronization with the faster uplink frequency, the received clock frequency could be increased by using a value of 1025 in Divider B 30. This would cause the first reference frequency 25 to be higher than the second reference frequency 31. The error voltage 27 would increase, and the VCO 28 would increase the frequency on lead 29 to 48.0469 KHz +/−25 ppm (27 MHz÷1125*1025÷2=48.0469 KHz +/−25 ppm) . Thus, the audio clock frequency would speed up, and would remain faster than the uplink clock for a duration such that the average clock speed will be maintened.

Thus, the variations in the 27 MHz frequency clock at the uplink site can be compensated for with one 27 MHZ frequency clock at the receiver. This invention provides an efficient, inexpensive method of generating the timing needed to process MPEG-2 digital video and audio signals, while additionally providing timing for CPU and modems.

Although a reliable 27 MHZ frequency clock has been shown and described in this application, it should be understood this invention is not to be limited to the exact form disclosed, and changes in detail and construction of the invention may be made without departing from the spirit thereof. Additionally, while the invention herein is disclosed within the framework of a DBS system, the method disclosed for generating multiple frequency timing signals from a single crystal is not limited to DBS systems.

What is claimed is:

1. A method of generating multiple frequencies from a single crystal oscillator in a video and audio satellite transmission system, said satellite transmission system including an uplink transmitter for providing a reference frequency for the encoding of the digital video and audio data stream and a receiver for the decoding of said data stream for display on a television set or monitor, the method comprising the steps of:

a) generating a standard reference frequency in the receiver which is substantially the same as used in the uplink transmitter, b) transmitting a synchronization clock pulse in the uplink transmission data and comparing that clock pulse with the standard reference frequency in the receiver;

c) processing the differences in the reference frequency to determine adjustment required; and d) adjusting the reference frequency by dividing the reference frequency by predetermined divisors to obtain a desired frequency for decoding the audio data stream to substantially synchronize the frequency of the decoding of the audio data stream in the receiver to that of the uplink transmission.

2. A method of generating multiple frequencies as described in claim 1 wherein a plurality of divisors are used to generate multiple frequencies for various purposes throughout said satellite receiver.

3. A method of generating multiple frequencies as described in claim 1 wherein the processor arbitrarily changes the divisors used in generating the frequency for the audio decoder as required to bring the frequency within a predetermined tolerance range with said uplink transmission reference frequency.

4. A method of generating multiple frequencies in an MPEG data transmission system having a transmitter and receiver for transferring an encoded digital data stream for the transmission and utilization of data; the method comprising the steps of a) generating a reference frequency in the receiver for the decoding of the data stream;

b) manipulating the reference frequency of the receiver by multiplying or dividing the frequency in order to obtain multiple frequencies for use in the receiver;

c) processing the reference frequency and comparing said frequency with a reference frequency in the transmitter in order to determine the difference in the receiver reference frequency from the transmitter frequency;

d) changing the multipliers and dividers to adjust the decoding frequencies within a tolerance range of the transmission reference frequency; and e) continuously monitoring the difference between the transmission and receiver frequency and maintaining the decoding frequency within said predetermined tolerance range.

* * * * *